US007921920B1

(12) United States Patent
Rosen

(10) Patent No.: US 7,921,920 B1
(45) Date of Patent: Apr. 12, 2011

(54) ANTI-CONING WELL INTAKE

(76) Inventor: Ian Kurt Rosen, Muskegon, MI (US)

( * ) Notice: Subject to any disclaimer, the term of this patent is extended or adjusted under 35 U.S.C. 154(b) by 332 days.

(21) Appl. No.: 12/052,796

(22) Filed: Mar. 21, 2008

(51) Int. Cl.
*E21B 43/32* (2006.01)

(52) U.S. Cl. ..... 166/369; 166/69; 166/242.1; 405/59

(58) Field of Classification Search ..... 166/369, 166/242.1, 69; 405/53, 59
See application file for complete search history.

(56) References Cited

U.S. PATENT DOCUMENTS

| | | | | |
|---|---|---|---|---|
| 454,432 | A * | 6/1891 | Heed | 166/369 |
| 1,499,589 | A * | 7/1924 | Navin | 166/265 |
| 1,548,803 | A | 8/1925 | Cotton | |
| 1,628,900 | A | 5/1927 | Neilsen | |
| 1,759,004 | A | 5/1930 | Dunlap | |
| 1,808,985 | A | 6/1931 | Helmling | |
| 2,229,541 | A | 1/1941 | Zublin | |
| 2,353,652 | A | 7/1944 | Coonrod | |
| 3,018,828 | A | 1/1962 | Prentiss | |
| 3,199,592 | A * | 8/1965 | Jacob | 166/306 |
| 3,208,537 | A * | 9/1965 | Scarborough | 175/53 |
| 3,297,088 | A | 1/1967 | Huitt et al. | |
| 3,636,976 | A * | 1/1972 | Hansel | 137/590 |
| 3,638,731 | A | 2/1972 | Driscoll | |
| 3,794,114 | A * | 2/1974 | Brandon | 166/249 |
| 3,842,908 | A * | 10/1974 | Thomas et al. | 166/268 |
| 4,016,930 | A * | 4/1977 | Arnold | 166/266 |
| 4,109,715 | A * | 8/1978 | Adamson | 166/177.6 |
| 4,253,490 | A * | 3/1981 | Hansel | 137/590 |
| 5,030,032 | A * | 7/1991 | Morsky et al. | 405/53 |
| 5,310,282 | A * | 5/1994 | Voskamp | 405/58 |
| 5,445,225 | A | 8/1995 | Wiggins, Sr. | |
| 5,896,928 | A | 4/1999 | Coon | |
| 6,112,815 | A | 9/2000 | Boe et al. | |
| 6,401,816 | B1 * | 6/2002 | Price et al. | 166/279 |
| 6,481,499 | B2 | 11/2002 | Lopes | |
| 6,494,258 | B1 | 12/2002 | Weingarten | |
| 6,715,558 | B2 | 4/2004 | Williamson | |
| 6,820,696 | B2 * | 11/2004 | Bergman et al. | 166/369 |
| 6,966,380 | B2 | 11/2005 | McLoughlin et al. | |
| 6,988,548 | B2 * | 1/2006 | Diamond et al. | 166/68 |
| 7,063,162 | B2 | 6/2006 | Daling et al. | |
| 7,240,739 | B2 | 7/2007 | Schoonderbeek et al. | |
| 7,273,106 | B2 | 9/2007 | Huckabee et al. | |
| 7,278,481 | B2 | 10/2007 | Eken | |
| 2002/0092648 | A1 | 7/2002 | Johnson et al. | |
| 2002/0096333 | A1 | 7/2002 | Johnson et al. | |
| 2002/0189815 | A1 | 12/2002 | Johnson et al. | |
| 2003/0000709 | A1 | 1/2003 | Gano | |
| 2004/0154806 | A1 | 8/2004 | Bode et al. | |
| 2004/0163819 | A1 | 8/2004 | Johnson et al. | |
| 2004/0244988 | A1 * | 12/2004 | Preston | 166/369 |
| 2005/0189106 | A1 | 9/2005 | Bode et al. | |
| 2006/0027372 | A1 | 2/2006 | Shaposhnikov et al. | |
| 2006/0076150 | A1 | 4/2006 | Coronado et al. | |
| 2006/0118296 | A1 | 6/2006 | Dybevik et al. | |
| 2006/0237197 | A1 * | 10/2006 | Dale et al. | 166/378 |
| 2007/0119588 | A1 | 5/2007 | Gonzalez | |

* cited by examiner

*Primary Examiner* — Jennifer H Gay
(74) *Attorney, Agent, or Firm* — Van Dyke, Gardner, Linn & Burkhart, LLP

(57) ABSTRACT

A well intake with an anti-coning end portion provides for withdrawal of fluid hydrocarbons, such as oil and gas, from pockets that contain an underlying layer of water. The anti-coning end portion may include a tube having an upwardly turned or upwardly facing end or mouth, a tube having a non-circular cross section, a tube having one or more baffles, or a combination thereof, in order to prevent or block the formation of cyclonic or swirling flow patterns of water in the vicinity of the well intake.

36 Claims, 4 Drawing Sheets

ANTI-CONING WELL INTAKE

FIELD OF THE INVENTION

The present invention relates generally to hydrocarbon well equipment and, more particularly, to intake pipes for drawing fluid hydrocarbons out of the ground.

BACKGROUND OF THE INVENTION

Oil and gas hydrocarbons are typically found within geological features, such as below land surfaces or sea floors. Such hydrocarbons may be found in commercial quantities in "traps" or "pockets" of various types. These traps or pockets may include pools of water located below the hydrocarbons, the hydrocarbons typically being less dense than water. When a pipe is driven into the ground to access the fluid hydrocarbons located in a trap, it is desirable to drive the intake end of the pipe as low as possible into the hydrocarbon pool so that a maximum quantity of hydrocarbons may be drawn out of the trap. However, when the intake end of a pipe is driven close to an underlying pool of water, or close to the boundary layer between a pool of water and an overlying pool of hydrocarbons, the intake pipe may be prone to draw water along with the hydrocarbons, especially when the flow rate is particularly high. This effect, commonly known as "coning," typically involves swirling or cyclonic motion or flow of the upper portion of the water layer as it is drawn into the intake pipe. Thus, the water layer may rise above its natural settling level in the vicinity of the intake pipe when overlying hydrocarbons are being drawn into the pipe and, undesirably, enter the intake pipe.

SUMMARY OF THE INVENTION

The present invention provides an intake device for extracting hydrocarbons from pockets or traps in land formations, the device being shaped to limit or substantially prevent the coning of water into the device. The device may include a curved or J-shaped tube for drawing hydrocarbons downwardly before reversing directions and being drawn upwardly into a pipe, and may include a non-circular pipe and/or baffles to limit or substantially prevent cyclonic or swirling motion of fluids in the vicinity of the intake device.

According to an aspect of the present invention, an anti-coning well intake for extracting hydrocarbons from geological formations includes a down-tube having an anti-coning end portion at a distal end thereof. The anti-coning end portion limits or substantially prevents the intake of water into the down-tube when hydrocarbons are being removed from the hydrocarbon deposit, and may limit or substantially prevent cavitation at the well intake. The anti-coning end portion may include a non-circular cross section, a curved or J-shaped tube, and/or a plurality of baffles.

Optionally, the anti-coning end portion may have a non-circular cross section or shape, such as a rectangular shape, a square shape, or an oval shape, to limit or substantially preclude cyclonic fluid flow at or around the end portion of the pipe. Optionally, the end portion may also or otherwise include internal baffles or the like for resisting the formation of cyclonic fluid flow or motion in the vicinity of the anti-coning end portion. For example, the anti-coning end portion may be circular in shape and may include a plurality of baffles.

Therefore, the present invention provides a device for removing hydrocarbons, such as oil or gas, from a subterranean pocket that includes an underlying pool of water, while substantially preventing the water from being drawn into the intake pipe. The device includes an anti-coning end portion that substantially prevents water from being drawn upwardly above the natural plane or boundary between the underlying water and overlying hydrocarbons, and which may reduce or prevent cavitation. The anti-coning end portion may draw hydrocarbons downwardly (such as via a generally J-shaped or upwardly turned end portion) to avoid coning, or may employ a non-circular cross section, baffles, or a combination thereof to inhibit the formation of cyclonic or swirling fluid flow into the intake pipe. The device of the present invention thus provides enhanced removal of hydrocarbons by reducing the removal of water with the hydrocarbons.

These and other objects, advantages, purposes, and features of the present invention will become apparent upon review of the following specification in conjunction with the drawings.

DESCRIPTION OF THE PREFERRED EMBODIMENTS

Figure 1:
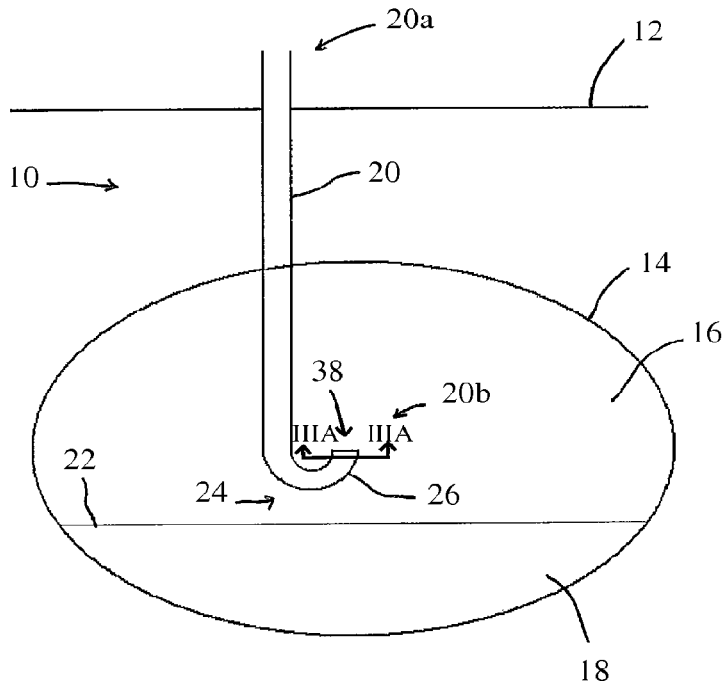
FIG. 1 is a side sectional view of a hydrocarbon extraction device having a J-shaped tube in accordance with the present invention, shown in a pocket of entrapped hydrocarbons and water.

Referring now to the drawings and the illustrative embodiments depicted therein, an anti-coning well intake or pipe 10 is driven through a geological surface 12 and into a subterranean trap or pocket 14 containing fluid hydrocarbons 16 above an underlying pool or layer of water 18 (FIG. 1). Anti-coning well intake 10 includes a down-pipe 20 with an upper or proximal end 20*a* generally located or positioned at or near the geological surface 12, and a lower or distal end portion 20*b* generally located within pocket 14 and above a boundary layer 22 between water 18 and hydrocarbons 16. An anti-coning end portion 24 of down-pipe 20 is located at distal end 20*b* and limits or substantially reduces or prevents the formation of conical or cyclonic or swirling flow of hydrocarbons 16 and/or water 18 into down-pipe 20, as discussed below.

Figure 2:
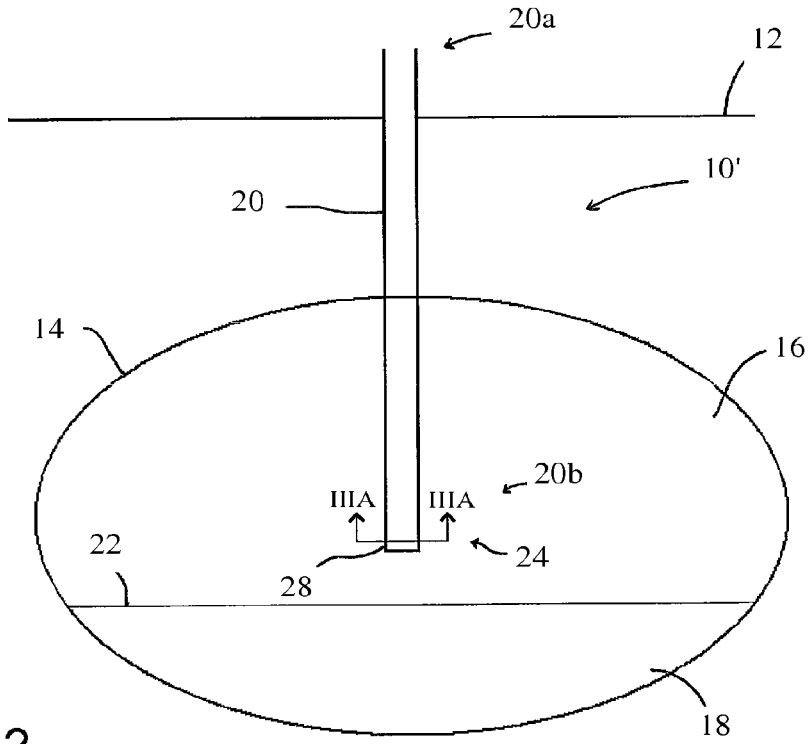
FIG. 2 is a side sectional view of another hydrocarbon extraction device of the present invention.
Figure 4:
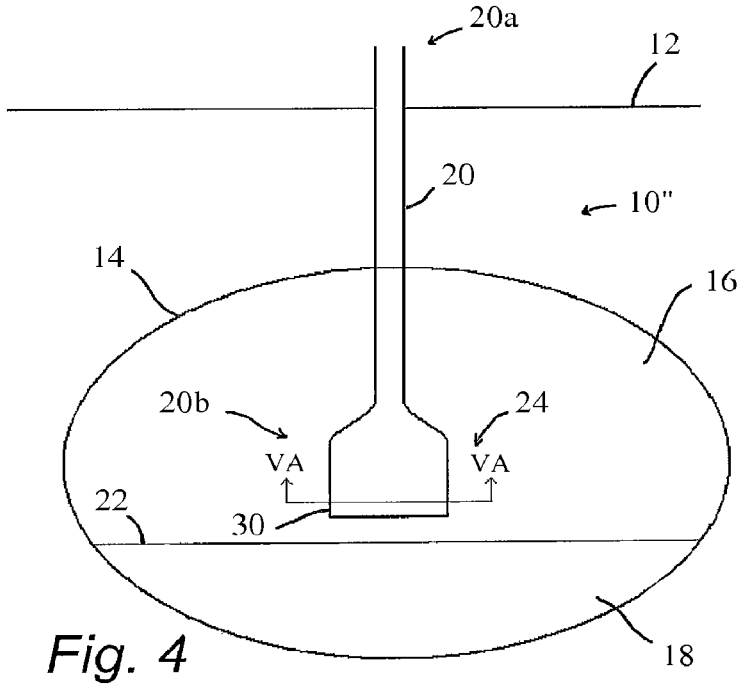
FIG. 4 is a side sectional view of another hydrocarbon extraction device in accordance with the present invention, shown in a pocket of entrapped hydrocarbons and water.

Anti-coning end portion 24 of anti-coning well intake 10 may comprise, for example, a curved or generally J-shaped tube 26 (FIG. 1), a generally straight end portion 28 (FIG. 2), or a flared end portion 30 (FIG. 4). After a hole is drilled generally downwardly through the geological surface 12 and into the pocket 14 containing fluid hydrocarbons 16 floating above water 18, pipe 20 is inserted through the hole until end portion 20*b* is positioned within the hydrocarbons 16 and above the water 18. Hydrocarbons 16 (such as oil) are then drawn into anti-coning end portion 24 at end portion 20*b* and upward along pipe 20, such as via a pump or suction device or fluid pressure or the like, and are discharged above ground, such as into a tank or pipeline, to extract the hydrocarbons for processing and/or use as fuel, or for lubricants or polymers or the like.

Referring to FIG. 1, the pipe or intake 10 may be located at the hydrocarbon pocket 14 such that the curved or J-shaped end portion or tube 26 is located with its inlet or mouth at a level above the water 18. J-shaped end portion or tube 26 prevents coning of water 18 into anti-coning end portion 24 by drawing hydrocarbons 16 substantially downwardly into an upwardly-turned or upwardly-facing distal end portion 20*b* before they are drawn upwardly into down-pipe 20. It will be appreciated that although J-shaped tube 26 may not prevent cyclonic flow of hydrocarbons 16 into J-shaped tube 26, such cyclonic flow is oriented such that fluids, such as water 18, that are located substantially below an upwardly-facing opening 38 of J-shaped tube 26, will not be drawn upwardly into the upwardly-facing opening 38. Rather, as hydrocarbons 16 are drawn into pipe 20, they are drawn downwardly into the upwardly-facing opening 38 of the J-shaped tube, whereby any conical or cyclonic flow will be oriented above the opening 38, and above and spaced from the water 18 and boundary layer 22.

Optionally, J-shaped tube 26 may be cylindrical (as in FIG. 3A) or non-circular (as in FIGS. 3B-3C), and may have one or more baffles for limiting or substantially preventing cyclonic flow patterns, such as described below. It will be appreciated that substantially any shape of a curved intake tube (not just a J-shaped tube) may be suitable with a generally upwardly-facing opening or mouth so that fluids are first drawn generally downwardly into the opening of the tube and before being drawn generally upwardly into and along the down-pipe and out of the pocket. For example, the tube may have an end or mouth that is at least partially directed upwardly and away from the water. Optionally, the tube may be at least partially flexible or deformable (or adjustable or formable) such that the tube may be inserted into the hydrocarbon, layer while in a substantially straight configuration, and then the tube may be bent or curved or otherwise formed or assembled to a desired shape with the end at least partially directed upwardly and away from the water layer.

Figure 3A:
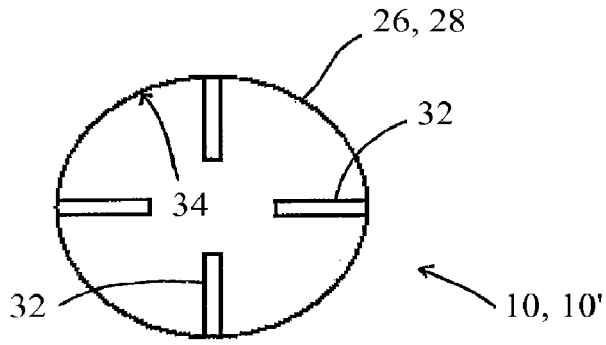
FIG. 3A is a sectional view of the hydrocarbon extraction device of FIG. 1 or FIG. 2 taken along section line IIIA-IIIA.

Optionally, the anti-coning end portion may comprise a generally straight end portion 28 (FIG. 2), which may have a non-circular cross section and/or may have baffles or the like disposed therein to limit coning of water during extraction of the hydrocarbons. For example, and as best seen in FIG. 3A, the end portion 28 of an anti-coning well intake or pipe 10' may be a round or circular-shaped end portion having one or more blocks or baffles 32 extending inwardly from an inner wall 34 of end portion 28. Baffles 32 are arranged or oriented generally perpendicularly to the flow direction of cyclonic or swirling motion of fluids and therefore limit or substantially prevent such flow paths into end portion 28 by blocking or interrupting any swirling or spiraling flow, thus limiting or substantially or entirely preventing coning of water into down-pipe 20. Baffles 32 may also substantially limit or prevent cavitation of hydrocarbons or water in the vicinity of the end portion 28. Baffles 32 may comprise plates at an end of the tube that span at least partially across the opening in the tube, and may span entirely across the opening. Optionally, the baffles may include holes or slots to allow fluid flow therethrough, while limiting conical or cyclonic flow. The baffles may be arranged generally longitudinally along the inner wall of the pipe, or may be arranged at an angled or non-longitudinal orientation along the pipe. Optionally, the baffles may extend longitudinally outwardly from the opening of the pipe, and/or may extend radially outwardly from the end portion of the pipe.

Figure 3B:
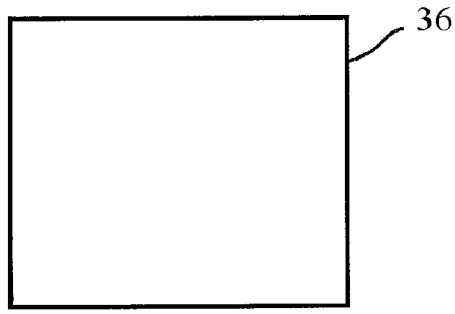
FIG. 3B is a sectional view of another hydrocarbon extraction device.
Figure 3C:
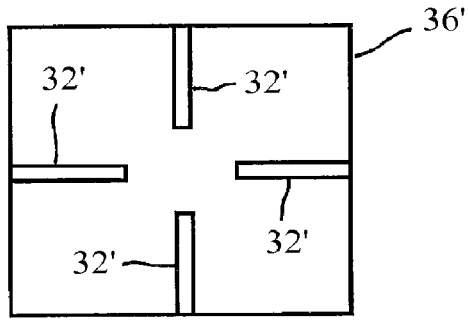
FIG. 3C is a sectional view of another hydrocarbon extraction device.

Alternatively, and as best seen in FIG. 3B, the anti-coning end portion 36 may comprise a square cross section or shape to reduce or prevent cyclonic flow into end portion 36. Optionally, and as shown in FIG. 3C, a square or rectangular shaped section or end portion or pipe 36' may include one or more baffles 32' therein to further reduce or prevent cyclonic flow into square end portion 36'. Square end portion 36, 36' is generally non-conducive to swirling or spiraling flow paths because the corners and straight edges are at least partially non-parallel to such flow paths and therefore interrupt or impede the development of swirling or spiraling flow paths of fluids. That is, if hydrocarbons being drawn into the square section 36, 36' begin to travel in a spiraling flow path, the fluid will encounter corners, edges, and baffles of square section 36, 36', thus imparting turbulent flow to the fluid and inhibiting or breaking up the spiraling flow path before it becomes fully developed and potentially leads to the intake of water into the pipe.

Figure 5A:
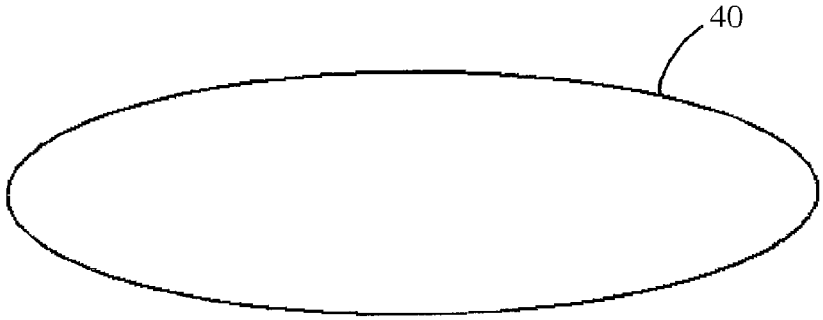
FIG. 5A is a sectional view of the hydrocarbon extraction device of FIG. 4 taken along section line VA-VA.
Figure 5B:
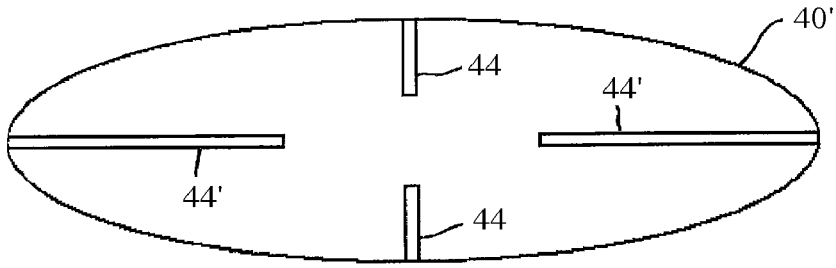
FIG. 5B is a sectional view of another hydrocarbon extraction device.
Figure 5C:
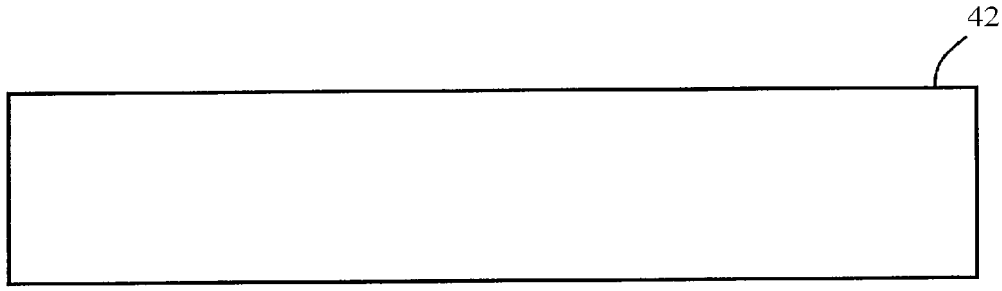
FIG. 5C is a sectional view of another hydrocarbon extraction device.
Figure 5D:
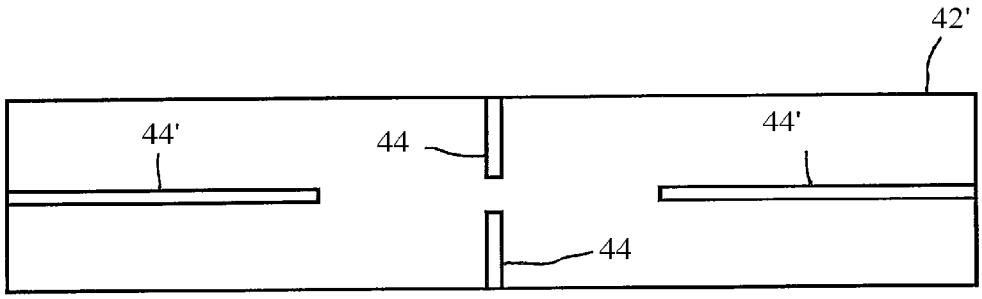
FIG. 5D is a sectional view of yet another hydrocarbon extraction device.

Optionally, and with reference to FIGS. 5A-D, the end portion of anti-coning well intake or pipe 10" may comprise a flared end portion 30, which may comprise a non-circular shape or cross section, such as an oval end portion 40, 40' (FIGS. 5A and 5B) or a rectangular end portion 42, 42' (FIGS. 5C and 5D). Oval end portion 40, 40' and rectangular end portion 42, 42' limit or prevent swirling or cyclonic motion or flow of hydrocarbons 16 and/or water 18 into flared end portion 30, and may incorporate anti-swirling blocks or baffles 44, 44' that function in substantially the same manner as baffles 32, 32', discussed above. Because swirling or cyclonic motion or flow of fluids is characterized by a generally circular flow path, the non-circular walls of oval end portion 40, 40' and rectangular end portion 42, 42' inhibit swirling or cyclonic motion by blocking or inducing turbulence in the fluid in a similar manner as described above with respect to square sections 36, 36'.

Therefore, the present invention provides an anti-coning well intake that permits the extraction of hydrocarbons from a pocket located below a geological surface without drawing water (which is typically denser than the hydrocarbons and thus disposed below the pool of hydrocarbons) into the down-pipe. The flow rate of hydrocarbons into the down-pipe may thus be increased without mixing water with the hydrocarbons, thus increasing hydrocarbon well efficiency and preventing the need to dispose of undesired water.

Changes and modifications in the specifically described embodiments can be carried out without departing from principles of the present invention, which is intended to be limited only by the scope of the appended claims, as interpreted according to the principles of patent law including the doctrine of equivalents.

The embodiments of the invention in which an exclusive property or privilege is claimed are defined as follows:

1. An anti-coning well intake for extracting hydrocarbons from geological formations, said well intake comprising:

a down-tube, said down-tube configured to penetrate a geological surface and a hydrocarbon, deposit located below the surface;

an anti-coning end portion at a distal end of said down-tube, said anti-coning end portion comprising an inner wall defining an intake mouth through which the hydrocarbons are removed from the hydrocarbon deposit, and at least one baffle at said distal end of said tube, wherein said end portion comprises a non-circular cross section;

wherein said at least one baffle projects inwardly from said inner wall of said anti-coning end portion; and wherein said anti-coning end portion is configured to substantially limit the intake of water into said down-tube during removal of hydrocarbons from the hydrocarbon deposit via said down-tube when said anti-coning end portion is located in a pool of hydrocarbons at a level above an underlying pool of water.

2. The anti-coning well intake of claim 1, wherein said anti-coning end portion comprises a rectangular cross section.

3. The anti-coning well intake of claim 1, wherein said anti-coning end portion comprises an oval cross section.

4. The anti-coning well intake of claim 1, wherein said at least one baffle is configured to substantially prevent cyclonic flow of the hydrocarbons and the water in the vicinity of said anti-coning end portion during removal of the hydrocarbons from the hydrocarbon deposit via said down-tube.

5. The anti-coning well intake of claim 1, wherein said anti-coning end portion comprises an upwardly-turned end portion.

6. The anti-coning well intake of claim 5, wherein said upwardly-turned end portion comprises a curved end portion with said mouth being substantially upwardly-facing and configured to initially draw hydrocarbons substantially downwardly during removal of the hydrocarbons.

7. The anti-coning well intake of claim 6, wherein said at least one baffle is configured to substantially prevent cyclonic flow of the hydrocarbons and the water in the vicinity of said curved end portion during removal of the hydrocarbons from the hydrocarbon deposit via said down-tube.

8. The anti-coning well intake of claim 5, wherein said mouth of said end portion comprises a non-circular cross section.

9. The anti-coning well intake of claim 1, wherein said at least one baffle is aligned with a direction of fluid flow in said anti-coning end portion.

10. An anti-coning well intake for extracting hydrocarbons from geological formations, said well intake comprising:

a down-tube, said down-tube configured to penetrate a geological surface and a hydrocarbon deposit located below the surface;

an anti-coning end portion at a distal end of said down-tube, said anti-coning end portion comprising a non-circular end portion having an upwardly-facing mouth, wherein said upwardly-facing mouth is configured to initially draw hydrocarbons substantially downwardly; and wherein said anti-coning end portion is configured to substantially prevent the intake of water into said down-tube during removal of hydrocarbons from the hydrocarbon deposit via said down-tube when said anti-coning end portion is located in a pool of hydrocarbons at a level above an underlying pool of water.

11. The anti-coning well intake of claim 10, wherein said end portion comprises a curved tube portion having said upwardly-facing mouth, and wherein said down-tube initially draws the hydrocarbons downward via said mouth and then draws the hydrocarbons upwardly after the hydrocarbons are drawn through said curved tube portion.

12. The anti-coning well intake of claim 10, wherein said anti-coning end portion comprises a rectangular cross section.

13. The anti-coning well intake of claim 10, wherein said anti-coning end portion further comprises:

an inner wall, said inner wall defining said upwardly-facing mouth through which the hydrocarbons are removed from the hydrocarbon deposit;

at least one baffle, said at least one baffle projecting inwardly from said inner wall of said anti-coning end portion; and wherein said at least one baffle is configured to substantially prevent cyclonic flow of the hydrocarbons and the water in the vicinity of said anti-coning end portion during removal of the hydrocarbons from the hydrocarbon deposit via said down-tube.

14. The anti-coning well intake of claim 13, wherein said at least one baffle is aligned with a direction of fluid flow in said anti-coning end portion.

15. The anti-coning well intake of claim 10, wherein said anti-coning end portion comprises an oval cross section.

16. An anti-coning well intake for extracting hydrocarbons from geological formations, said well intake comprising:

a down-tube, said down-tube configured to penetrate a geological surface and a hydrocarbon deposit located below the surface;

an anti-coning end portion at a distal end of said down-tube, said anti-coning end portion having an inner wall, said inner wall defining an intake mouth through which hydrocarbons are removed from the hydrocarbon deposit;

at least one longitudinally-extending rigid baffle, said at least one baffle projecting inwardly from and fixedly attached to said inner wall of said anti-coning end portion;

wherein said anti-coning end portion comprises a non-circular cross section; and wherein said anti-coning end portion is configured to substantially prevent the intake of water into said down-tube during removal of hydrocarbons from the hydrocarbon deposit via said down-tube when said anti-coning end portion is located in a pool of hydrocarbons at a level above an underlying pool of water.

17. The anti-coning well intake of claim 16, wherein said at least one baffle is arranged longitudinally along said inner wall of said anti-coning end portion.

18. The anti-coning well intake of claim 16, wherein said at least one baffle comprises a plurality of baffles.

19. The anti-coning well intake of claim 16, wherein said anti-coning end portion comprises a rectangular cross section.

20. The anti-coning well intake of claim 19, wherein said anti-coning end portion comprises a square cross section.

21. The anti-coning well intake of claim 16, wherein said anti-coning end portion comprises an oval cross section.

22. An anti-coning well intake for extracting hydrocarbons from geological formations, said well intake comprising:

a down-tube, said down-tube adapted to penetrate a geological surface and a hydrocarbon deposit located below the surface;

an anti-coning end portion at a distal end of said down-tube, said anti-coning end portion comprising a non-circular cross section; and wherein said anti-coning end portion is adapted to substantially prevent the intake of water into said down-tube during removal of hydrocarbons from the hydrocarbon deposit via said down-tube when said anti-coning end portion is located in a pool of hydrocarbons at a level above an underlying pool of water.

23. The anti-coning well intake of claim 22, wherein said anti-coning end portion comprises a rectangular cross section.

24. The anti-coning well intake of claim 23, wherein said anti-coning end portion further comprises:

an inner wall, said inner wall defining an intake mouth through which the hydrocarbons are removed from the hydrocarbon deposit;

a plurality of baffles, said baffles projecting inwardly from said inner wall of said anti-coning end portion; and wherein said baffles are adapted to substantially prevent cyclonic flow of the hydrocarbons and the water in the vicinity of said anti-coning end portion during removal of the hydrocarbons from the hydrocarbon deposit via said down-tube.

25. The anti-coning well intake of claim 24, wherein said baffles are aligned with a direction of fluid flow in said anti-coning end portion.

26. The anti-coning well intake of claim 22, wherein said anti-coning end portion comprises a square cross section.

27. The anti-coning well intake of claim 26, wherein said anti-coning end portion further comprises:

an inner wall, said inner wall defining an intake mouth through which the hydrocarbons are removed from the hydrocarbon deposit;

at least one baffle, said at least one baffle projecting inwardly from said inner wall of said anti-coning end portion; and wherein said at least one baffle is adapted to substantially prevent cyclonic flow of the hydrocarbons and the water in the vicinity of said anti-coning end portion during removal of the hydrocarbons from the hydrocarbon deposit via said down-tube.

28. The anti-coning well intake of claim 22, wherein said anti-coning end portion comprises an oval cross section.

29. The anti-coning well intake of claim 28, wherein said anti-coning end portion further comprises:

an inner wall, said inner wall defining an intake mouth through which the hydrocarbons are removed from the hydrocarbon deposit;

a plurality of baffles, said baffles projecting inwardly from said inner wall of said anti-coning end portion; and wherein said baffles are configured to substantially prevent cyclonic flow of the hydrocarbons and the water in the vicinity of said anti-coning end portion during removal of the hydrocarbons from the hydrocarbon deposit via said down-tube.

30. A method of extracting hydrocarbons from a hydrocarbon deposit overlying a pool of water, said method comprising:

providing an anti-coning well intake for extracting hydrocarbons from geological formations, said well intake comprising a down-tube, said down-tube configured to penetrate a geological surface and a hydrocarbon deposit located below the surface;

providing an anti-coning end portion at a distal end of said down-tube, said anti-coning end portion comprising an inner wall defining an intake mouth through which the hydrocarbons are removed from the hydrocarbon deposit, and at least one baffle at said distal end of said tube, said at least one baffle projecting inwardly from said inner wall of said anti-coning end portion, and wherein said anti-coning end portion comprises a non-circular cross section;

wherein said anti-coning end portion is configured to substantially prevent the intake of water into said down-tube during removal of hydrocarbons from the hydrocarbon deposit via said down-tube;

extracting hydrocarbons through said anti-coning well intake without extracting water therewith when said anti-coning end portion is located in a pool of hydrocarbons at a level above an underlying pool of water; and substantially preventing cyclonic flow of the hydrocarbons and the water in the vicinity of said anti-coning end portion with said baffle during removal of the hydrocarbons from the hydrocarbon deposit through said intake mouth.

31. The method of claim 30, wherein said anti-coning end portion comprises a rectangular cross section.

32. The method of claim 30, wherein said anti-coning end portion comprises an oval cross section.

33. The method of claim 30, wherein said anti-coning end portion comprises an upwardly-turned end.

34. The method of claim 33, wherein said upwardly-turned end comprises a curved end portion having a substantially upwardly-facing intake mouth configured to initially direct hydrocarbons substantially downwardly and then draw the hydrocarbons upwardly after the hydrocarbons are drawn through said curved end portion.

35. The method of claim 30, wherein said at least one baffle comprises a plurality of baffles.

36. The method of claim 30, wherein said at least one baffle is aligned with a direction of fluid flow in said anti-coning end portion.

* * * * *